US006717347B2

(12) United States Patent
Kubosaka et al.

(10) Patent No.: US 6,717,347 B2
(45) Date of Patent: Apr. 6, 2004

(54) FUNNEL-AND-NECK SEALING BODY FOR PROJECTION TUBE

(75) Inventors: Mamoru Kubosaka, Otsu (JP); Michiharu Eta, Otsu (JP)

(73) Assignee: Nippon Electric Glass Co., Ltd., Shiga-ken (JP)

( * ) Notice: Subject to any disclaimer, the term of this patent is extended or adjusted under 35 U.S.C. 154(b) by 0 days.

(21) Appl. No.: 10/233,291

(22) Filed: Aug. 28, 2002

(65) Prior Publication Data

US 2004/0041512 A1 Mar. 4, 2004

(30) Foreign Application Priority Data

Aug. 29, 2002 (JP) ..... 2001-259073

(51) Int. Cl.[7] ..... H01J 31/00

(52) U.S. Cl. ..... 313/477 R; 313/478; 313/440; 313/421; 220/2.1 A

(58) Field of Search ..... 313/477 R, 478, 313/440, 421; 220/2.1 A

(56) References Cited

U.S. PATENT DOCUMENTS

| | | | | |
|---|---|---|---|---|
| 3,163,794 A | | 12/1964 | Bloomsburgh et al. | 313/76 |
| 4,982,158 A | | 1/1991 | Nakata et al. | 324/263 |
| 5,126,654 A | | 6/1992 | Murphy et al. | 324/71.2 |
| RE34,131 E | * | 11/1992 | Vriens et al. | 313/474 |
| 6,404,119 B1 | | 6/2002 | Hidaka et al. | 313/477 R |
| 2002/0180335 A1 | * | 12/2002 | Saitou et al. | 313/477 R |
| 2003/0030361 A1 | | 2/2003 | Hirota et al. | 313/440 |
| 2003/0038583 A1 | * | 2/2003 | Suzuki et al. | 313/478 |

FOREIGN PATENT DOCUMENTS

| | | |
|---|---|---|
| EP | 3424308 | 1/1985 |
| EP | 19819066 | 11/1999 |
| JP | 48-90673 | 11/1973 |
| JP | 03-192636 | 8/1991 |
| JP | 11-135037 | 5/1999 |
| JP | 11-185660 | 7/1999 |

* cited by examiner

*Primary Examiner*—Ashok Patel
*Assistant Examiner*—Sikha Roy
(74) *Attorney, Agent, or Firm*—J.C. Patents

(57) ABSTRACT

A funnel-and-neck sealing body comprises a funnel having a substantially rectangular large opening to which a panel for projection tube is sealed, and a circular small opening; and a neck tube of substantially a cylindrical shape sealed to the small opening of the funnel. The neck tube has an electron gun installing region for installing an electron gun therein, and a yoke mounting region for mounting a deflection yoke externally thereon, wherein an outer diameter of the yoke mounting region is smaller than an outer diameter of the electron gun installing region.

2 Claims, 5 Drawing Sheets

FIG. 4A
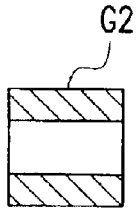
FIG. 4B
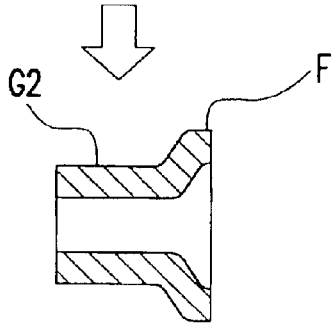
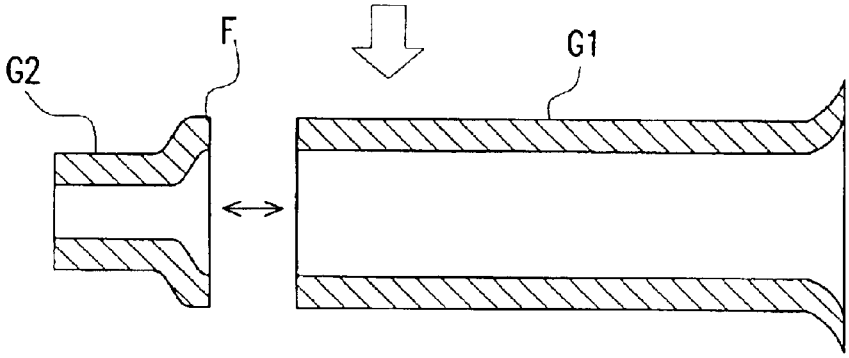
FIG. 4C

FUNNEL-AND-NECK SEALING BODY FOR PROJECTION TUBE

CROSS-REFERENCE TO RELATED APPLICATION

This application claims the priority benefit of Japanese Patent 2003-68234 A published Jul. 3, 2003.

BACKGROUND OF THE INVENTION

1. Field of the Invention

This invention relates in general to a funnel-and-neck sealing body for projection tube.

2. Description of Related Art

As shown in FIG. 6, a glass member forming a cathode ray tube for a projection tube (projection tube, hereinafter) comprises a panel 30 whose inner surface is coated with fluorescent material, a neck tube 32 in which an electron gun is installed, and a funnel 33 connecting the panel 30 and the neck tube 32. These elements arc sealed to each other with frit glass, or with fusing the elements themselves, thus a glass bulb 34 is formed.

The inside of the glass bulb 34 is highly vacuumed in order to make electrons emit out of the electron gun 31, and a deflection yoke 35 is externally mounted between the neck tube 32 and the funnel 33. Electron beams emitted from the electron gun 31 are controlled by the deflection yoke 35 to collide with the fluorescent material, thereby to make the fluorescent material emit light, in a fluorescent film coated on the inner surface of the panel 30, and thereby the image is displayed.

The projection tube is different from the general consumer direct-view type cathode ray tube where the image displayed on the panel is directly viewed. For example, as shown in FIG. 7, the electron beams are made to collide with the fluorescent material on the inner surface of the panel 30 to emit light. The image displayed on the light-emitted surface is projected and enlarged by a lens set 37 onto a screen 39 that is separately arranged in front of the projection tube 38. The viewer can observe, watch and view the enlarged projection image. Therefore, in comparison with the consumer cathode ray tube, the projection tube is required to have a higher light brightness. Increasing the light brightness can be achieved by increasing the strength and the amount that the electron beams emitted from the electron gun 31 collide with the fluorescent material on the inner surface of the panel 30. However, in the projection tube 38 for enlarging and projecting the image, if the electron beams do not illuminate a very small area on the light-emitting surface of the projection tube 38, the pixel of the enlarged and projected image becomes rough and the image quality might be reduced, so that the focus accuracy of the electron gun 31 has also to be increased. According to Ludwig Von Seidel's aberration theory, the spherical aberration, the comatic aberration and the astigmatism become better as the aperture of the lens, i.e., the diameter of the electronic lens of the electron gun 31 is larger.

According to the aforementioned reasons, in comparison with the consumer cathode ray tube of direct view type that has the same size, the electronic lens of the electron gun used in the projection tube has a larger aperture, so that the neck tube for installing the electron gun also has a larger outer diameter.

In recent years, with the requirements of high brightness, the high definition for projection tubes is further increased, and therefore, an electron gun having an electronic lens with a diameter larger than before has to be installed and the outer diameter of the neck tube has to be made larger accordingly. However, to enlarge the outer diameter of the neck tube will make the separation distance between the deflection yoke externally mounted on the neck tube and the electron beams passing through the inside of the neck tube become longer, which causes a reduction of the deflection sensitivity. In order to obtain a desired deflection sensitivity for the electron beams, an energy power larger than prior art has to be provided to the deflection yoke, or the deflection coil has to be increased in size to increase its output power. However, in the previous case, because of the power tolerance of the deflection yoke itself, the calorific quantity will increase and harmful effects due to the difference of the thermal expansion with the other parts might occur. For the latter case, because the length in the tube axis direction of the deflection coil becomes longer, the problem that the projection tube itself becomes larger is inevitable.

Additionally, for the projection tube that has to use a large electron gun, because the power consumption particularly required for activating the projection tube is large, to save power consumption is strongly demanded. The power consumption of the deflection yoke for deflecting the electron beams dominates among the total power consumption of the projection tube. Therefore, to particularly reduce the power for the horizontal deflection makes a significant contribution to saving the power consumption.

The power for the horizontal deflection is proportional to the inner diameter of the deflection coil and the acceleration voltage applied to the electron gun, and is inversely proportional to the length of the deflection coil. Therefore, in order to reduce the power for the horizontal deflection, to reduce the applied acceleration voltage, to reduce the frequency of the horizontal deflection, to reduce the inner diameter of the deflection coil, or to increase the length in the tube axis direction of the deflection coil has been considered. However, because to reduce the applied acceleration voltage will reduce the energy with which the electrons of the electron beams collide with the fluorescent material, the brightness of the fluorescent material will decrease. To reduce the frequency of the horizontal deflection will cause a reduction of the image quality. Furthermore, because a reduction of the inner diameter of the deflection coil will cause a reduction of the outer diameter of the neck tube, the diameter of the electronic lens of the electron gun installed in the neck tube has to be reduced, so that the focus accuracy required for the projection tube is reduced. To increase the length in the tube axis direction of the deflection coil will inevitably enlarge the projection tube.

SUMMARY OF THE INVENTION

According to the foregoing description, an object of this invention is to provide a funnel-and-neck sealing body for projection tube, which can contribute to make a projection tube installed a large electron gun therein compact, and to reduce the power consumption significantly, while maintaining the high brightness and the high definition required for projection tubes.

To achieve the foregoing objects, the invention provides the following funnel-and-neck sealing body for projection tube. The funnel-and-neck sealing body comprises a funnel having a substantially rectangular large opening to which a panel for projection tube is sealed, and a circular small opening; and a neck tube of substantially a cylindrical shape sealed to the small opening of the funnel. The neck tube has an electron gun installing region for installing an electron gun therein, and a yoke mounting region for mounting a deflection yoke externally thereon, wherein an outer diameter of the yoke mounting region is smaller than an outer diameter of the electron gun installing region.

In the above structure, preferably, a diagonal outer diameter of the large opening is 80 mm~330 mm, a ratio of the outer diameter of the electron gun installing region with respect to the diagonal outer diameter of the large opening is 9%~36%, and a ratio of the outer diameter of the yoke mounting region with respect to the outer diameter of the electron gun installing region is 50%~90%.

In addition, in the above structure, preferably, relationships of $2 \leqq L/L1 \leqq 10$ and $5 \leqq L/L2$ are satisfied, where a length in a tube axis direction of the yoke mounting region is L1, a length in the tube axis direction of a connection region between the yoke mounting region and the electron gun installing region is L2, and a total length in the tube axis direction of the neck tube is L.

Additionally, the neck tube includes a flare type that contains an excess portion, which will be cut after the electron gun is inserted, at one end of the neck tube through which the electron gun is inserted, and the one end is formed in a flare-shape; and a flareless type that does not contain an excess portion, which will be cut after the electron gun is inserted, and is formed as a straight tube till the end of the neck tube. For the neck tube of flare type, after the electron gun is inserted, a stem provided at the base portion of the electron gun is fusion bonded to the opening formed by cutting the excess portion containing the flare portion. In contrast, for the neck tube of the flareless type, after the electron gun is inserted, the stem of the electron gun is directly fusion bonded to the opening formed at the end of the neck tube. The neck tube of the invention can be any one of the flare type and the flareless type. In addition, according to the invention, the total length L in the tube axis direction of the neck tube means a distance from an opening for sealing the funnel to a position of another opening where the stem is fusion bonded when installing the electron gun.

According to the invention, the outer diameter of the yoke mounting region at the side that is sealed with the funnel of the neck tube is smaller than the outer diameter of the electron gun installation mounting region, by which an electron gun having an electronic lens set of large diameter for obtaining a high focus accuracy can be installed. Furthermore, by mounting the deflection yoke onto the yoke mounting region whose outer diameter is relatively small, the distance between the deflection yoke and the electron beams can be set a minimum distance, so that the deflection power for deflecting the electron beams can be suppressed to minimum and the deflection yoke can be made smaller, while installing a large electron gun for displaying an image of high brightness and high definition required by a projection tube.

The invention is particularly suitable for a cathode ray tube for projection tube, in which the diagonal outer diameter of the large opening is 80 mm~330 mm, the ratio of the outer diameter of the electron gun installing region with respect to the diagonal outer diameter of the large opening is 9%~36%, and the ratio of the outer diameter of the yoke mounting region with respect to the outer diameter of the electron gun installing region is 50%~90%. Namely, regarding the projection tube, in comparison with the direct-view type cathode ray tube, due to the requirements of high brightness, high definition and high focus accuracy, the aperture of the electronic lens of the electron gun with respect to the size of the panel having a light-emitting surface is larger than that of the cathode ray tube of the direct-view type having the same panel size. Therefore, the neck tube for installing the electron gun also has to use a neck tube with a large outer diameter. The invention, particularly as to the range shown above, is suitable for a projection tube where the outer diameter of the electron gun with respect to the panel size is larger. In addition, if the ratio of the outer diameter of the yoke mounting region with respect to the outer diameter of the electron gun installing region is too small, the yoke mounting region will be extremely shrunk and an extreme difference of size with the outer diameter of the electron gun installing region will occur, so that the strength is easily decreased. In contrast, if the ratio of the outer diameter of the yoke mounting region with respect to the outer diameter of the electron gun installing region is too large, the deflection efficiency will reduce and saving the power consumption becomes difficult. Therefore, setting the ratio of the outer diameter of the yoke mounting region with respect to the outer diameter of the electron gun installing region in the above range can provide a sufficient strength when used for a glass bulb for projection tube as a vacuum vessel. Furthermore, the deflection power can be suppressed to minimum, and the electron beams emitted from the electron gun can be well deflected even though the deflection yoke is small, while installing a large electron gun, which is suitable for achieving the high brightness, the high definition and the high focus accuracy required by a projection tube.

In addition, because the focus accuracy is inversely proportional to a distance where the electrons emitted from the electron gun collide with the fluorescent material, if the ratio of the yoke mounting region with respect to the total length of the neck tube is too large, the installing position of the electron gun will recede to the rear end (opposite to the funnel) of the neck tube. Therefore, the distance to the fluorescent material is increased, and the focus accuracy easily becomes worse. In contrast, if the ratio of the yoke mounting region with respect to the total length of the neck tube is too small, for the projection tube, because the deflection of the electron beams emitted from the electron gun is started from the inside of the neck tube, the region for mounting the deflection yoke which deflects the electrons immediately emitted from the electron gun cannot be secured, and resultantly, the deflection efficiency is reduced. Moreover, since the deflection efficiency of the deflection yoke is also inversely proportional to the distance of the electron beams that are converged by the electron lens being deflected by the deflection yoke, if the connection region, where the tube diameter varies, between the yoke mounting region and the electron gun installing region is too long, the deflection efficiency will reduced.

Therefore, it is much preferred that the length L1 in the tube axis direction of the yoke mounting region and the total length L in the tube axis direction of the neck tube has a relationship of $2 \leqq L/L1 \leqq 10$, and additionally, the length L2 in the tube axis direction of the connection region between the yoke mounting region and the electron gun installing region and the total length L in the tube axis direction of the neck tube have a relationship of $5 \leqq L/L2$.

By satisfying the above relationships, particularly for the projection tube that has to install a large electron gun, it is possible to attain a high deflection efficiency in the projection tube, to make the projection tube compact, and to reduce the power consumption significantly, while maintain high brightness, high definition, and high focus accuracy.

BRIEF DESCRIPTION OF THE DRAWINGS

While the specification concludes with claims particularly pointing out and distinctly claiming the subject matter which is regarded as the invention, the objects and features of the invention and further objects, features and advantages thereof will be better understood from the following description taken in connection with the accompanying drawings in which:

FIGS. 4A~4C are a manufacturing process for a funnel-and-neck sealing body for projection tube according to the embodiment of the invention;

DESCRIPTION OF THE PREFERRED EMBODIMENT

Figure 1:
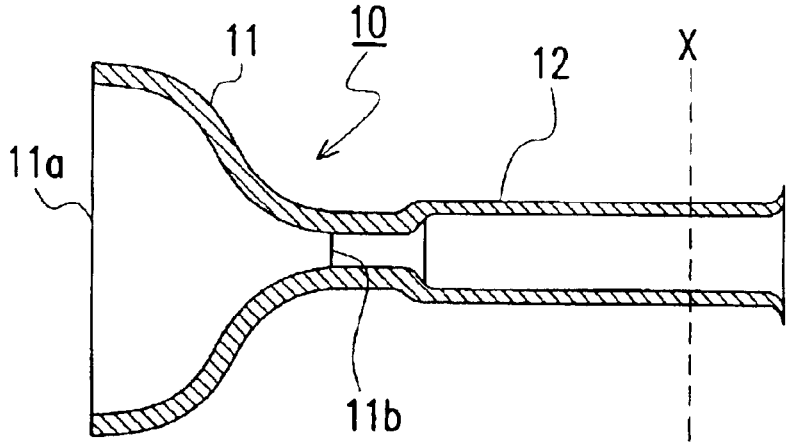
FIG. 1 is a cross-sectional view of a funnel-and-neck sealing body for projection tube according to an embodiment of the invention.
Figure 2:
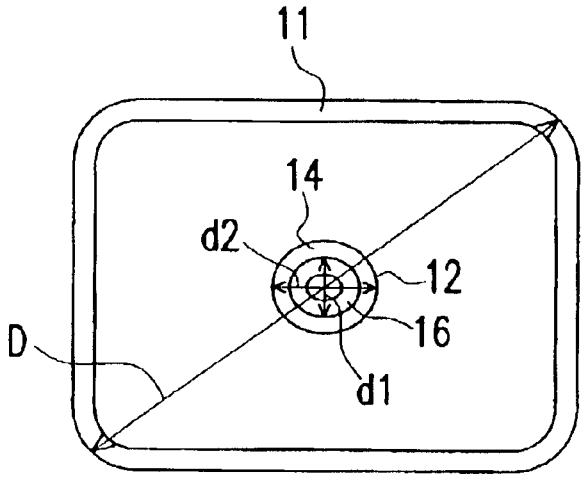
FIG. 2 is a front view of a funnel-and-neck sealing body for projection tube according to the embodiment of the invention.
Figure 3:
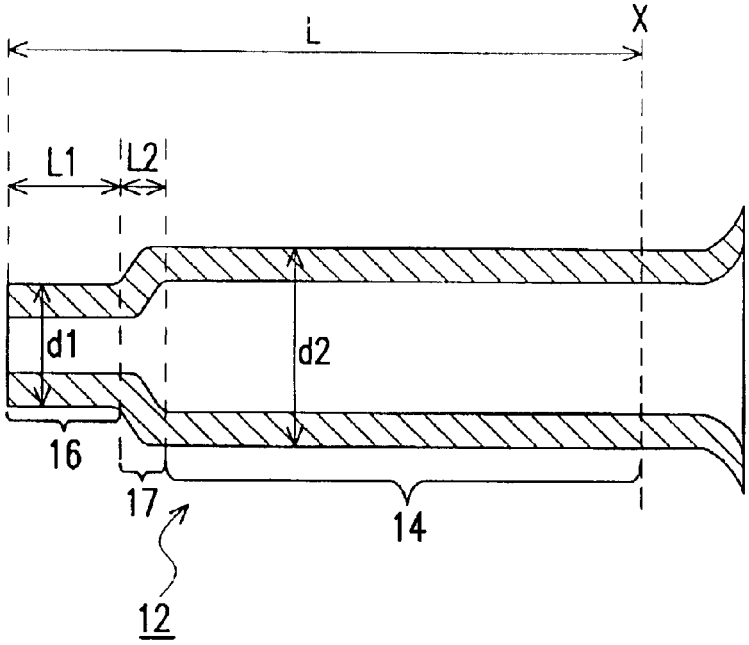
FIG. 3 is an enlarged cross-sectional view of a funnel-and-neck sealing body for projection tube according to the embodiment of the invention.
Figure 5:
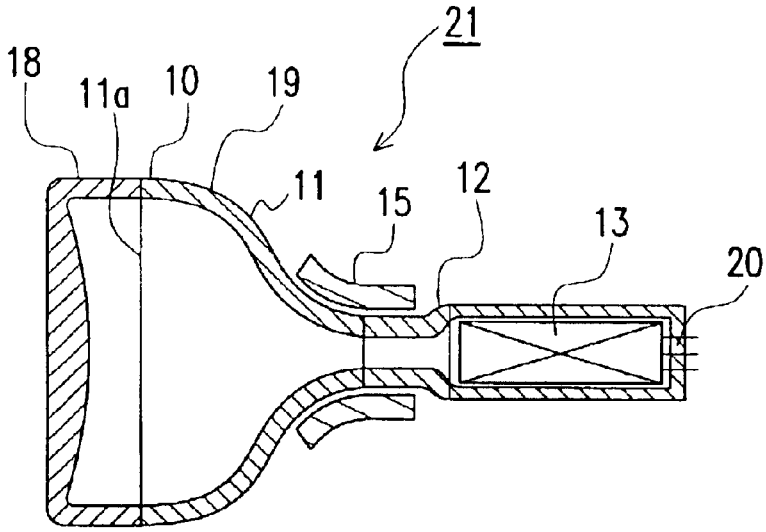
FIG. 5 is a diagram for describing that the funnel-and-neck sealing body for projection tube according to the embodiment used in a glass bulb for projection tube.
Figure 6:
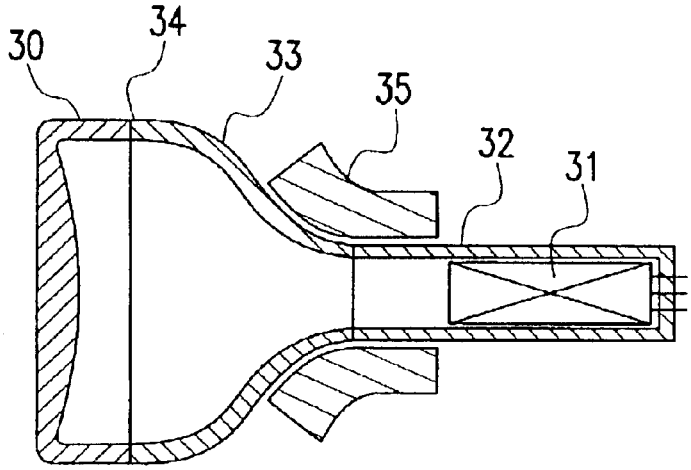
FIG. 6 (PRIOR ART)
FIG. 6 is a diagram for describing a projection tube using a conventional funnel-and-neck sealing body for projection tube.
Figure 7:
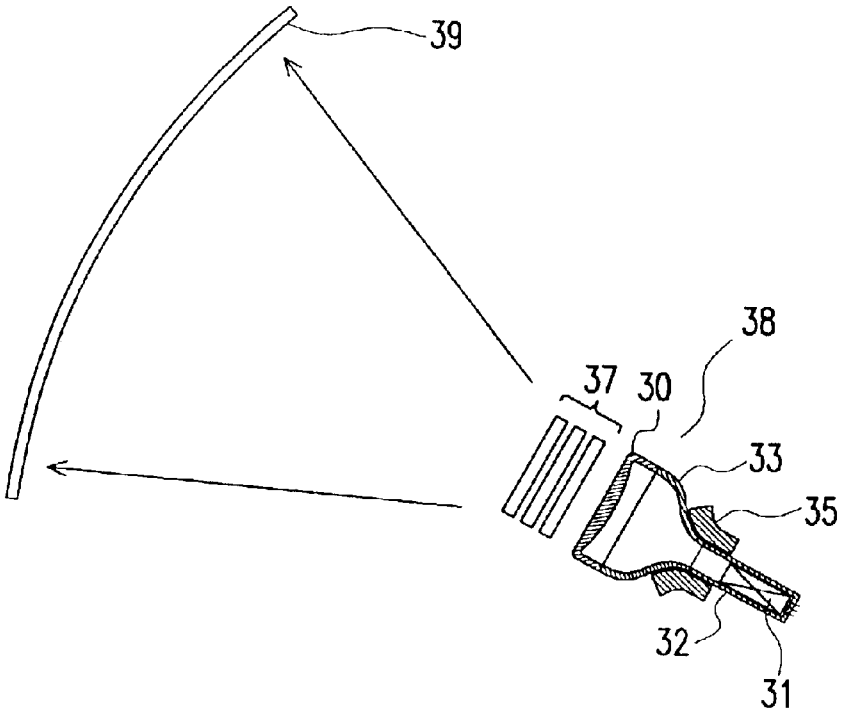
FIG. 7 (PRIOR ART)
FIG. 7 shows an application using the projection tube.

The preferred embodiment of the invention is described in detail accompanied by FIGS. 1~5. The funnel-and-neck sealing body 10 for projection tube comprises a funnel 11 having a substantially rectangular large opening 11*a* and a circular small opening 11*b*, and a substantially cylindrical neck tube 12 sealed to the small opening 11*b* of the funnel 11.

Regarding the rectangular large opening 11*a* of the funnel 11, in order to seal a panel 18 for projection tube, the diagonal outer diameter D thereof has the same size as the diagonal outer diameter of the panel 18 for projection tube, i.e., 175 mm.

The neck tube 12 has an electron gun installing region 14 for installing an electron gun 13 therein, and a yoke mounting region 16 for mounting a deflection yoke 15 externally thereon. The glass thickness of the neck tube 12 is 2.5 mm, the outer diameter d1 of the yoke mounting region 16 is 29.1 mm, and the outer diameter d2 of the electron gun installing region 14 is 36.5 mm. Therefore, the ratio of the outer diameter d2 of the electron gum installing region 14 with respect to the diagonal outer diameter D of the large opening 11*a* of the funnel 11 is 20%, and the ratio of the outer diameter d1 of the yoke mounting region 16 with respect to the electron gun installing region 14 is 79%.

In addition, the neck tube 12 is a flare-type neck tube one end of which, where the electron gun 13 is inserted, contains an excess portion that will be cut after the electron gun 13 is inserted, and is formed in a flared shape. The length L1 in the tube axis direction of the yoke mounting region 16 of the neck tube is 25 mm, the total length L in the tube axis direction of neck tube 12 from an opening for sealing with the funnel 11 of the yoke mounting region 16 to a position in the electron gun installing region 14 (the position is shown by the dashed line X in FIG. 1 and FIG. 3) at which a stem is fusion bonded when installing the electron gun 13 is 144 mm, and the length L2 in the tube axis direction of a connection region 17 between the yoke mounting region 16 and the electron gun installing region 14 is 13 mm.

As shown in FIGS. 4A~4C, the method for producing the neck tube 12 comprises the following steps. First, a glass tube G1 with a large diameter as the electron gun installing region 14 and a glass tube G2 with a small diameter as the yoke mounting region 16 are prepared. One end of the glass tube G2 with a small diameter is heated by a burner to soften it, and then by pressing an umbrella-shape pressing member against the inner surface of the softened glass tube G2, thereby a flare portion F is formed so that the outer diameter of the end portion thereof becomes to be the same as the outer diameter of the glass tube G1 with a large diameter, and then the glass tube G2 is cooled. Next, make the end face of the flare portion F of the glass tube G2 with a smaller diameter face with one end of the glass tube G1 with a large diameter, so that the tube axes of the two glass tubes G1, G2 are maintained to align with the same line. Then, the two faced end surfaces are heated by a burner to be fusion bonded. When using the gas burner for fusion bonding, since the softened and fused glass is easily collapsed inwards the glass tube due to the ejection pressure of the gas from the tip of the burner, nitrogen gas or air may be conducted into the glass tubes to somewhat increase the inner pressure of the glass tubes after fusion bonding the two glass tubes till cooling and solidifying the fused portion sufficiently.

In addition to the above method, for example, for a glass tube having a predetermined length with an outer diameter of the electron gun installing region, a portion for the yoke mounting region may be externally heated by a burner and then be pressed by a roller to reduce in diameter.

Using the funnel-and-neck sealing body for projection tube with the neck tube 12, a glass bulb 19 is constituted by fusion bonding the panel 18 for projection tube with a diagonal outer diameter of 173 mm whose inner surface is coated with a fluorescent film to the large opening 11*a* of the funnel 11. In addition to fusion bonding, the panel and the funnel may be sealed through a frit grass interposed between the joining surfaces thereof.

Next, the electron gun 13 having an electron lens with a diameter of 30 mm is inserted into the electron gun installing region 14 of the neck tube 12, and an excess portion at the end of the neck tube 12 is cut to form an opening. By fusion bonding a stem 20 provided at the base portion of the electron gun 13 to the opening, the electron gun 13 is installed into the neck tube 12. Then, by externally mounting the deflection yoke 15 spanned across the funnel 11 onto the yoke mounting region 16 of the neck tube 12, a projection tube 21 is constituted.

In a comparative example, a funnel-and-neck sealing body for projection tube in which the thickness of a neck tube is the same as the above embodiment, and an outer diameter of the neck tube is 36.5 mm both at an electron gun installing region and at an yoke mounting region, and a panel having the same size as the above embodiment are used to constitute a projection tube.

In each of the projection tube using the funnel-and-neck sealing body for projection of the invention and the projection tube using the funnel-and-neck sealing body for projection of the comparative example, an electron gun is necessary to be provided for obtaining the desired brightness, definition and the focus accuracy required for projection tubes, and a deflection yoke is also necessary to be provided for deflecting the electron beams emitted from the electron gun. In order to obtain the brightness, definition and the focus accuracy having the same level as the invention, the comparative example requires a large deflection yoke.

As a result, the projection tube using the funnel-and-neck sealing body for projection of the invention can be reduced in the whole length of the projection tube by 5%, thereby can be made compact, and the power for deflection can be reduced by 30%~40%, in comparison with the comparative example, while maintaining the high brightness, the high definition and the high focus accuracy required by projection tubes.

As described above, the funnel-and-neck sealing body for projection tube according to the invention can contribute to make a projection tube installed a large electron gun therein compact, and to reduce the power consumption significantly, while maintaining the high brightness and the high definition required for projection tubes.

While the present invention has been described with a preferred embodiment, this description is not intended to limit our invention. Various modifications of the embodiment will be apparent to those skilled in the art. It is therefore contemplated that the appended claims will cover any such modifications or embodiments as fall within the true scope the invention.

What is claimed is:

1. A funnel-and-neck sealing body for projection tube, comprising:

a funnel having a substantially rectangular large opening to which a panel for projection tube is sealed, and a circular small opening; and a neck tube of substantially a cylindrical shape sealed to the small opening of the funnel, wherein the neck tube has an electron gun installing region for installing an electron gun therein, and a yoke mounting region for mounting a deflection yoke externally thereon, and wherein an outer diameter of the yoke mounting region is smaller than an outer diameter of the electron gun installing region; and wherein relationships of $2 \leqq L/L1 \leqq 10$ and $5 \leqq /L2$, are satisfied, where a length in a tube axis direction of the yoke mounting region is L1, a length in the tube axis direction of a connection region between the yoke mounting region and the electron gun installing region is L2, and a total length in the tube axis direction of the neck tube is L.

2. The funnel-and-neck sealing body for projection tube according to claim 1, wherein a diagonal outer diameter of the large opening is 80 mm~330 mm, a ratio of the outer diameter of the electron gun installing region with respect to the diagonal outer diameter of the large opening is 9%~36%, and a ratio of the outer diameter of the yoke mounting region with respect to the outer diameter of the electron gun installing region is 50%~90%.

* * * * *